US009873576B2

(12) United States Patent
Kondo

(10) Patent No.: US 9,873,576 B2
(45) Date of Patent: Jan. 23, 2018

(54) SHEET FEEDING APPARATUS AND IMAGE FORMING APPARATUS

(71) Applicant: CANON KABUSHIKI KAISHA, Tokyo (JP)

(72) Inventor: Takashi Kondo, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/098,815

(22) Filed: Apr. 14, 2016

(65) Prior Publication Data

US 2016/0327897 A1 Nov. 10, 2016

(30) Foreign Application Priority Data

May 8, 2015 (JP) ..... 2015-095891

(51) Int. Cl.
*B65H 3/06* (2006.01)
*G03G 15/00* (2006.01)
(Continued)

(52) U.S. Cl.
CPC ..... *B65H 3/0684* (2013.01); *B65H 1/04* (2013.01); *B65H 3/5253* (2013.01); *B65H 5/062* (2013.01);
(Continued)

(58) Field of Classification Search
CPC .. B65H 3/0684; B65H 3/0669; B65H 3/5261; B65H 3/5253; B65H 3/5215; B65H 2403/51; B65H 2403/511; B65H 2403/512; B65H 2403/514; B65H 2402/31; B65H 2404/1421; B65H 2404/14211; B65H 2404/152; B65H 2404/1521; B65H 2301/423245
(Continued)

(56) References Cited

U.S. PATENT DOCUMENTS 5,201,873 A * 4/1993 Kikuchi ..... B41J 13/0018 271/117
6,651,972 B2 * 11/2003 Hsiao ..... B65H 3/0615 271/10.12
(Continued)

FOREIGN PATENT DOCUMENTS

JP H0626990 B2 * 4/1994 ..... B65H 3/0669
JP 2005-075479 A 3/2005
JP 2013-173601 A 9/2013

*Primary Examiner* — Ernesto Suarez
(74) *Attorney, Agent, or Firm* — Fitzpatrick, Cella, Harper & Scinto

(57) ABSTRACT

A sheet feeding apparatus capable of lifting a feed roller at low cost without increasing size thereof and an image forming apparatus including the same are proposed. A sheet fed from a rotary feed member is conveyed by a rotary conveyance member while being separated one by one by a rotary separation member being in contact with the rotary conveyance member. The rotary feed member is moved between a standby position above the sheet and an abutment position where the rotary feed member abuts with the sheet by a lifting portion. The lifting portion includes an actuation member moving a holding portion up and down and a drive member driving the actuation member. The actuation member is disposed on a second shaft, which is configured to rotate the rotary separation member.

13 Claims, 14 Drawing Sheets

(51) Int. Cl.

| | |
|---|---|
| ***B65H 1/04*** | (2006.01) |
| ***B65H 5/06*** | (2006.01) |
| ***B65H 5/26*** | (2006.01) |
| ***B65H 3/52*** | (2006.01) |

(52) U.S. Cl.
CPC ..... *B65H 5/26* (2013.01); *G03G 15/6511* (2013.01); *G03G 15/6514* (2013.01); *G03G 15/6529* (2013.01); *B65H 2301/423245* (2013.01); *B65H 2402/31* (2013.01); *B65H 2403/512* (2013.01); *B65H 2404/1421* (2013.01); *G03G 2215/00396* (2013.01); *G03G 2215/0132* (2013.01)

(58) Field of Classification Search
USPC ..... 271/117, 118
See application file for complete search history.

(56) References Cited

U.S. PATENT DOCUMENTS

| | | | | |
|---|---|---|---|---|
| 7,098,430 | B2 | 8/2006 | Kondo et al. | |
| 7,122,769 | B2 | 10/2006 | Nami et al. | |
| 7,132,631 | B2 | 11/2006 | Nami et al. | |
| 7,490,827 | B2 * | 2/2009 | Miki | B65H 3/06 271/117 |
| 8,646,904 | B2 * | 2/2014 | Sakano | B65H 3/0684 271/4.1 |
| 8,800,986 | B2 | 8/2014 | Tomatsu | |
| 9,221,634 | B2 * | 12/2015 | Tanaka | B65H 3/0669 |
| 9,272,862 | B2 * | 3/2016 | Tateishi | B65H 3/0684 |
| 2016/0347560 | A1 * | 12/2016 | Murata | B65H 3/0669 |
| 2017/0066608 | A1 * | 3/2017 | Kondo | B65H 3/0669 |

* cited by examiner

SHEET FEEDING APPARATUS AND IMAGE FORMING APPARATUS

BACKGROUND OF THE INVENTION

Field of the Invention

The present invention relates to a sheet feeding apparatus and to an image forming apparatus including the sheet feeding apparatus.

Description of the Related Art

A conventional image forming apparatus such as a printer, a copier, a facsimile includes a sheet feeding apparatus feeding a sheet to an image forming unit. The sheet feeding apparatus includes a pickup roller delivering the sheet stacked on a sheet supporting portion and a separating portion separating the sheet one by one in case the pickup roller delivers multiple sheets.

The separating portion includes a retard separating system in which a feed roller rotating in the same direction with a pickup roller and a retard roller in pressure contact with the feed roller with a predetermined pressure-contact force (nip pressure). It is noted that a drive of a certain torque (rotational torque), is applied to the retard roller in a direction reverse to a sheet conveyance direction (reverse direction) through a torque limiter, so that the retard roller can rotate in either direction of the sheet conveyance direction and the reverse direction.

The separating portion of the retard separating system prevents multiple feeding by rotating the retard roller in the reverse direction when two or more sheets enter a nip portion (separating nip portion), between the retard roller and the feed roller. The retard roller rotates following the feed roller when one sheet or no sheet enters the separating nip portion.

In order to improve stability in the sheet feeding operation, some sheet feeding apparatuses having the separating portion of the retard separating system are configured to switch the pickup roller between a separation state in which the pickup roller is separated from the sheet on the tray and an abutment state in which the pickup roller abuts with the sheet. In the case of a manual sheet feeding apparatus as an example of sheet feeding apparatus in particular, a user cannot set a sheet on a manual sheet feed tray in the abutment state. Therefore, it is necessary to switch the pickup roller to the separation state in setting the sheet.

Therefore, a conventional sheet feeding apparatus includes a lift mechanism lifting the pickup roller from an abutment position where the pickup roller is in contact with the sheet and to a separate position separated from the sheet. In setting the sheet, the pickup roller is moved to the separate state by the lift mechanism. As such a lift mechanism, U.S. Pat. No. 8,800,986 discloses a configuration using an idle gear interposed between the pickup roller and the feed roller. In this configuration, a corrugated washer is disposed between a holder liftably holding the pickup roller and the idle gear. Then, the holder turns by a frictional force generated by the corrugated washer when the idle gear rotates, and a pressing force pressing the pickup roller against the sheet is generated.

Japanese Patent Application Laid-open No. 2005-75479 also discloses another lift mechanism configured to lift a pickup roller through a cam rotated by a motor.

Here, since the contact pressure of the pickup roller against the sheet depends on the frictional force between the members in the lift mechanism described in U.S. Pat. No. 8,800,986, there is a possibility that the contact pressure is unstablized due to wear of frictional surfaces and to environmental conditions such as humidity.

In the case of the lift mechanism lifting the pickup roller by the cam driven by the motor and a cam follower actuated by the cam, it is possible to avoid such situation that the contact pressure of the pickup roller against the sheet fluctuates due to the friction and others. However, in the case of the lift mechanism using the cam and the cam follower, it has been difficult to dispose the cam and the cam follower in such a manner as to realize downsize of the apparatus. In the case of the manual sheet feeding apparatus, which is disposed in a narrow space in a side part of the image forming apparatus, in particular, the disposition of the cam and the cam follower is essential because the lift mechanism is also required to be downsized.

SUMMARY OF THE INVENTION

According to one aspect of a sheet feeding apparatus of the invention, the sheet feeding apparatus includes a sheet supporting portion, a rotary feed member, a rotary conveyance member, a rotary separation member, rotary conveyance member, a second shaft, a holding portion, a lifting portion, and a drive unit. The rotary feed member feeds a sheet supported on the sheet supporting portion and the rotary conveyance member conveys the sheet fed from the rotary feed member. The second shaft is configured to rotate the rotary separation member, which separates the sheet with the rotary conveyance member. The rotary feed member is held by the holding portion, which moves up and down. The lifting portion moves the holding portion to move the rotary feed member to a standby position above the sheet and an abutment position where the rotary feed member abuts with the sheet. The lifting portion includes a drive member driven by the drive unit and an actuation member driven by the drive member and turns the holding portion up and down. The actuation member is disposed on the second shaft.

According to another aspect of a sheet feeding apparatus of the invention, the sheet feeding apparatus includes a sheet supporting portion, a rotary feed member, a rotary conveyance member, a rotary separation member, rotary conveyance member, a second shaft, a holding portion, a cam shaft, a cam follower, and an abutment portion. The rotary feed member is held by the holding portion, which pivots up and down, and feeds the sheet. The rotary conveyance member is rotated by the first shaft and conveys the sheet fed from the rotary feed member. The second shaft is configured to rotate the rotary separation member to separate the sheet with the rotary conveyance member. The cam shaft is attached with a cam and rotates by being driven by a driving source. The cam follower is supported on the second shaft and turns independently from the second shaft along with a rotation of the cam. The abutment portion provided on the holding portion is abuttable with the cam follower. In response to a rotation of the cam, the cam follower turns the holding portion through the abutment portion to move the rotary feed member between a standby position above the sheet and an abutment position where the rotary feed member abuts with the sheet supported on the sheet supporting portion.

Further features of the present invention will become apparent from the following description of exemplary embodiments with reference to the attached drawings. The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Figure 1:
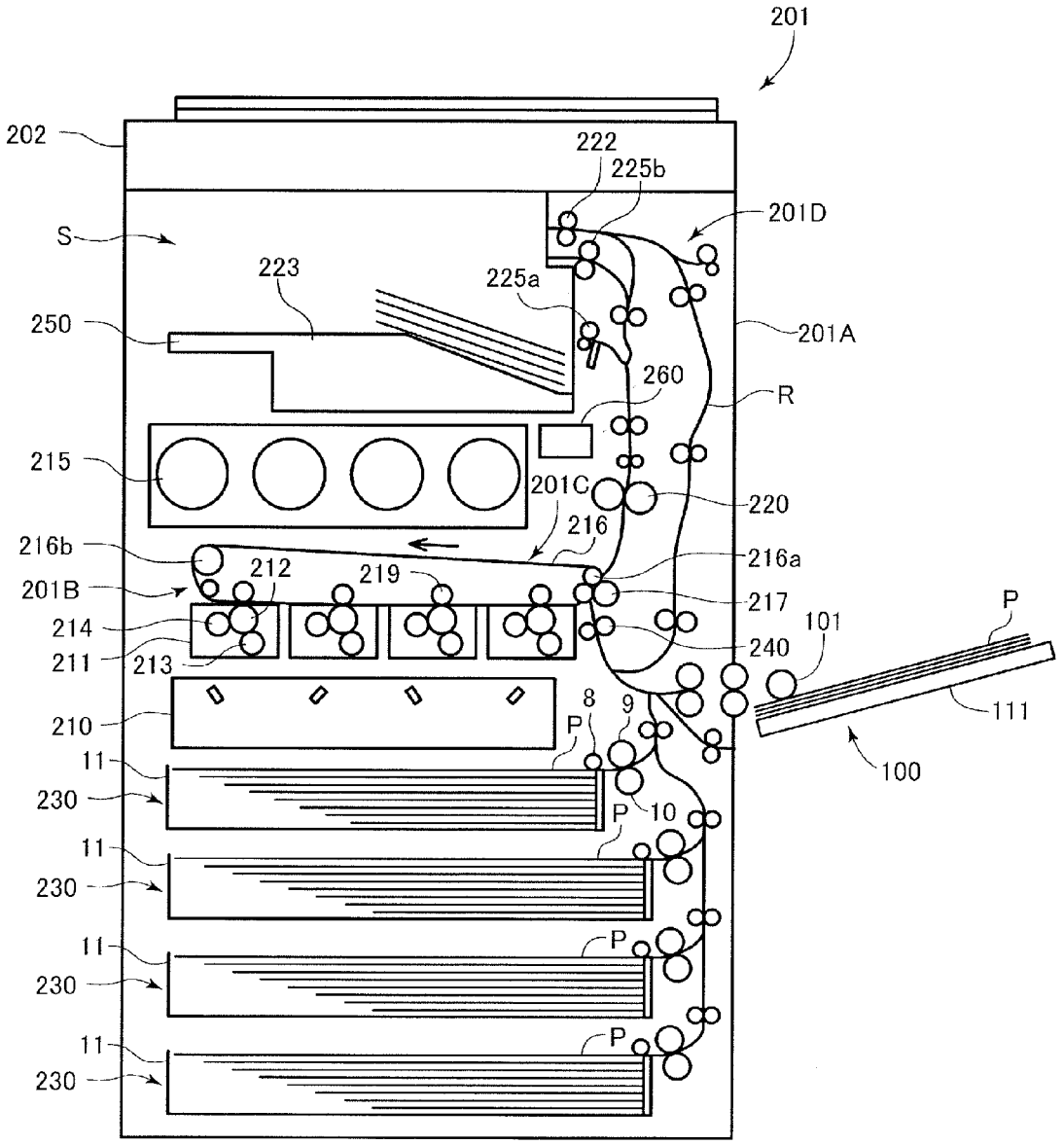
FIG. 1 is a diagram schematically illustrating an entire configuration of a full-color laser printer, i.e., one exemplary image forming apparatus including a sheet feeding apparatus.

An embodiment of the present invention will be described in detail below with reference to the drawings. FIG. 1 is a diagram schematically illustrating an entire configuration of a full-color laser printer, i.e., one exemplary image forming apparatus including a sheet feeding apparatus, of the present embodiment.

In FIG. 1, a printer body 201A, i.e., an image forming apparatus body of the full-color laser beam printer (referred to simply as a 'printer' hereinafter) 201, is provided with an image forming unit 201B forming an image on a sheet. Above the printer body 201A is provided an image reading apparatus 202, which is an upper apparatus disposed approximately horizontally. A sheet discharge space S is formed between the image reading apparatus 202 and the printer body 201A. Provided under the printer body 201A are sheet feeding apparatuses 230 respectively feeding the sheet P from each sheet feed cassette 11. A manual sheet feeding apparatus 100, which serves as a sheet feeding apparatus and includes a manual sheet feed tray 111 on which a sheet is set manually, is provided on one side surface of the printer body 201A.

The image forming unit 201B is a four drum full-color type and includes a laser scanner 210 and four process cartridges 211 forming toner images of four colors of yellow (Y), magenta (M), cyan (C), and black (K). Here, each process cartridge 211 includes a photosensitive drum 212, an electric charger 213, a developer 214, and a cleaner not shown. The image forming unit 201B also includes an intermediate transfer unit 201C disposed above the process cartridges 211.

The intermediate transfer unit 201C includes an intermediate transfer belt 216 wrapped around a driving roller 216*a* and a tension roller 216*b*. The intermediate transfer unit 201C includes primary transfer rollers 219 provided inside a loop of the intermediate transfer belt 216 and in contact with the intermediate transfer belt 216 at positions respectively facing the photosensitive drums 212. Here, the intermediate transfer belt 216 is composed of a film member, is disposed so as to be in contact with the respective photosensitive drums 212, and is rotated in a direction of an arrow in FIG. 1 by a driving roller 216*a* driven by a drive unit not shown.

Then, each toner image having negative polarity on the photosensitive drum is sequentially superimposed and transferred onto the intermediate transfer belt 216 by a positive transfer bias applied to the intermediate transfer belt 216 through the primary transfer roller 219. Thereby, the color image is formed on the intermediate transfer belt 216. A secondary transfer roller 217 composing a secondary transfer portion transferring the color image formed on the intermediate transfer belt 216 is provided at a position facing the driving roller 216*a* in the intermediate transfer unit 201C.

Still further, a fixing unit 220 is disposed above the secondary transfer roller 217, and a reverse discharge unit 201D is disposed above (on an upper-left side in the FIG. 1) of the fixing unit 220. The reverse discharge unit 201D includes a first sheet discharge roller pair 225*a*, a second sheet discharge roller pair 225*b*, and a reversing portion including a reversing roller pair 222, i.e., a sheet reversing conveying roller capable of reversing a sheet, and a re-conveying path R conveying a sheet on which an image has been formed on one surface thereof again to the image forming unit 201B.

The sheet feeding apparatus 230 includes a sheet feed cassette 11 and a pickup roller 8 coming into contact with and an uppermost sheet among the sheets P stored in the sheet feed cassette 11 and rotating to deliver the uppermost sheet out of the sheet feed cassette 11. The manual sheet feeding apparatus 100 is configured to feed a large size sheet which cannot be stored in the sheet feed cassette 11, a sheet whose rigidity is high such as an envelope and a postcard, and a special sheet such as an OHP sheet and an embossed sheet, other than a plain sheet. The manual sheet feeding apparatus 100 includes a manual sheet feed tray 111 on which the sheet is set and a pickup roller 101 feeding the sheet on the manual sheet feed tray 111. The printer 201 also includes toner cartridges 215 replenishing toners to the developers 214 and a control portion 260, which controls an image forming operation of the printer body 201A and sheet feeding operations of the sheet feeding apparatus 230 and the manual sheet feeding apparatus 100.

Next, the image forming operation of the printer 201 will be described. When image information of a document is read by the image reading apparatus 202, the image information is processed and is then converted into electrical signals to be transmitted to the laser scanner 210 of the image forming unit 201B. In the image forming unit 201B, a surface of the photosensitive drum 212 is uniformly charged to the predetermined potential in the predetermined polarity by the charger 213. Then, the surface of the photosensitive drum 212 is sequentially exposed by a laser beam from the laser scanner 210.

Thereby, electrostatic latent images, each corresponding to a monochromatic image of yellow, magenta, cyan, and black, are sequentially formed on the photosensitive drums 212 of the process cartridges 211. After that, the electrostatic latent images are developed and visualized by the respective color toners. Then, the respective color toner images on the photosensitive drums 212 are sequentially superimposed and transferred onto the intermediate transfer belt 216 by the primary transfer bias applied to the primary transfer rollers 219. Thus, the toner image is formed on the intermediate transfer belt 216.

In parallel with the image forming operation, the sheet P stored in the sheet feed cassette 11 is delivered by the pickup roller 8, i.e., a rotary feed member, provided in the sheet feeding apparatus 230. The delivered sheet P is separated one by one by a separating portion composed of a feed roller 9, i.e., a rotary conveyance member, and a retard roller 10, i.e., a rotary separation member, in pressure contact with the feed roller 9. The sheet P is then conveyed to a registration roller pair 240 to correct a skew of the sheet P. In a case of manually feeding a sheet, the sheet P set on the manual sheet feed tray 111 is delivered and conveyed by a pickup roller 101, i.e., a rotary feed member, toward the registration roller pair 240.

After correcting the skew, the sheet P is conveyed by the registration roller pair 240 to the secondary transfer portion where the toner images are collectively transferred onto the sheet P by the secondary transfer bias applied to the secondary transfer roller 217. The sheet P onto which the toner images have been transferred is conveyed to the fixing unit 220 to undergo heat and pressure in the fixing unit 220. Thereby, the respective color toners melt and blend with each other and are fixed as a color image on the sheet P.

After that, the sheet P onto which the image has been fixed is discharged to a sheet discharge space S by a first sheet discharge roller pair 225*a* and a second sheet discharge roller pair 225*b* provided downstream of the fixing unit 220 and is stacked on a stacking portion 223 projecting on a bottom surface of the discharge space S. In the case of forming images on both surfaces of the sheet P, the sheet P is conveyed to the re-conveying path R by a reversing roller pair 222 and is conveyed again to the image forming unit 201B.

Figure 2:
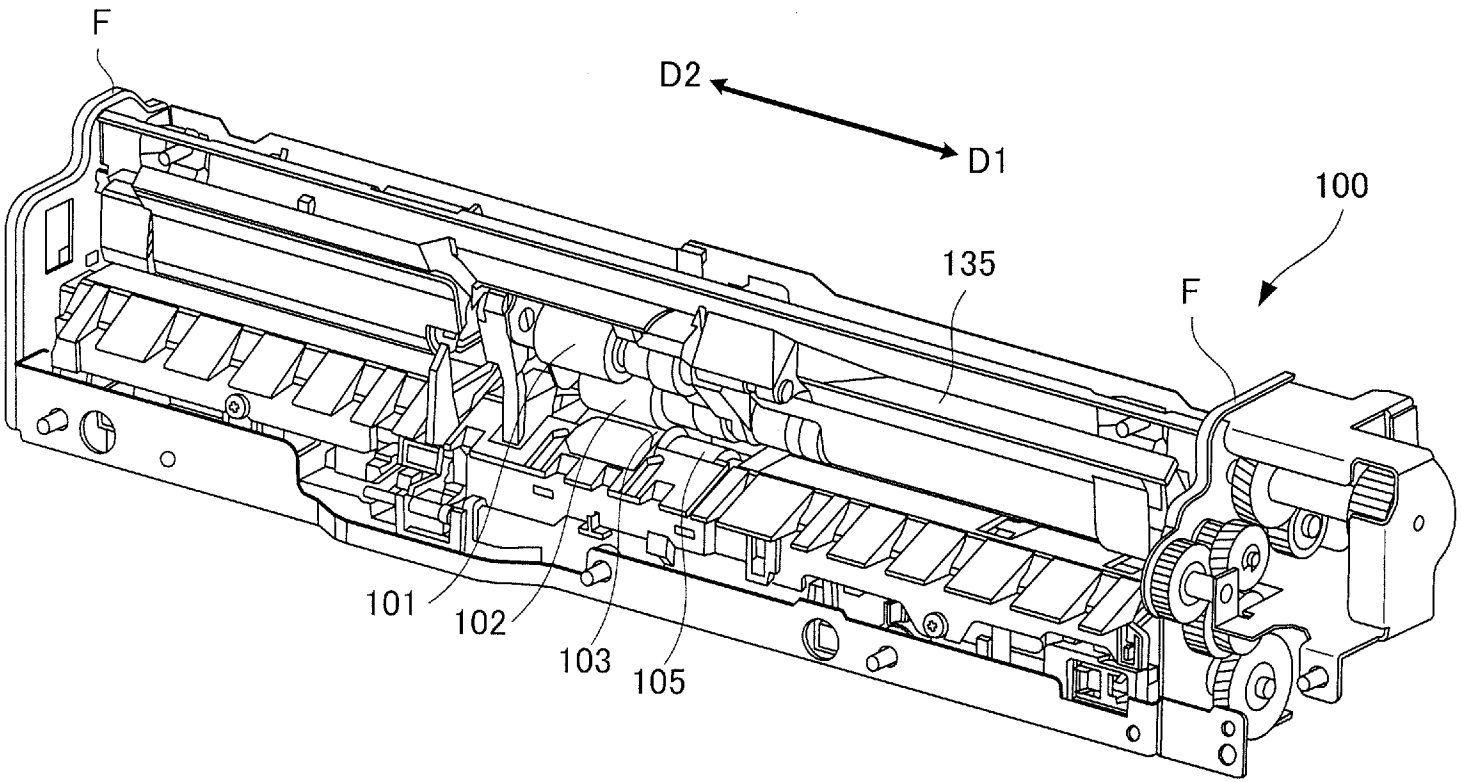
FIG. 2 is a perspective view illustrating a manual sheet feeding apparatus, which is a sheet feeding apparatus.

FIG. 2 is a perspective view illustrating a main part of the manual sheet feeding apparatus 100. The manual sheet feeding apparatus 100 includes a pickup roller 101 and a feed roller 102, the feed roller serving as a rotary conveyance member and disposed downstream in a sheet feeding direction of the pickup roller 101. The feed roller 102 is configured to rotate in a same direction with the pickup roller 101 (see FIG. 3). The manual sheet feeding apparatus 100 also includes a retard roller 103, i.e., a rotary separation member, provided to be in pressure contact with the feed roller 102 from under the feed roller 102. The retard roller 103 is rotatable in a direction following the sheet feeding direction through a torque limiter 105. The feed roller 102 and the retard roller 103 compose a separating portion that separates sheets fed from the pickup roller 101 one by one.

Figure 3:
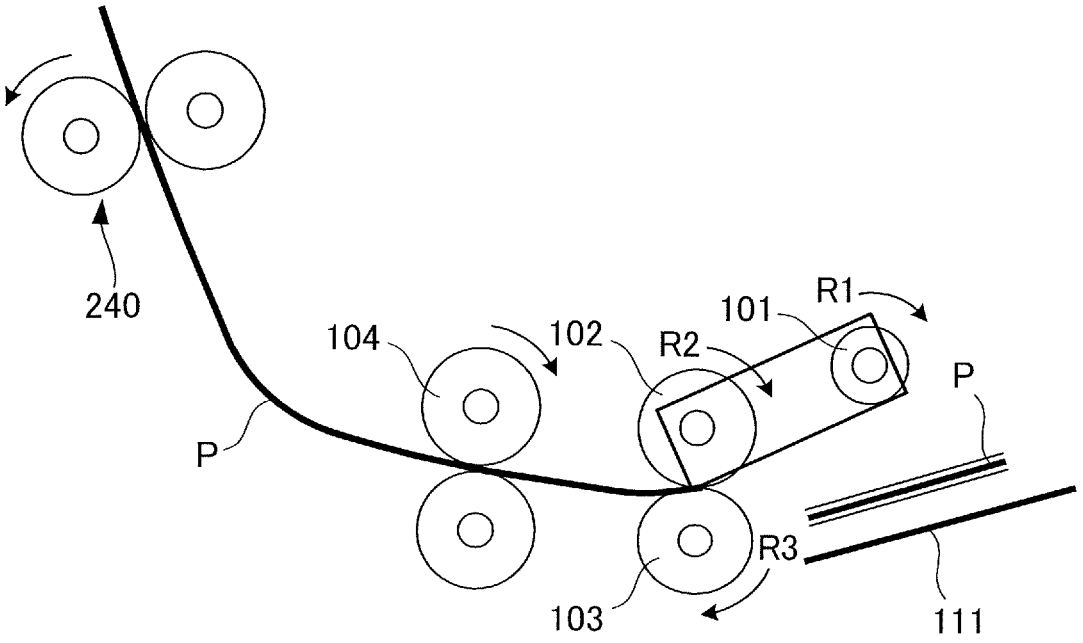
FIG. 3 is a schematic diagram illustrating a movement of a sheet after being fed by the manual sheet feeding apparatus.

As shown in FIG. 3, even if two or more sheets are delivered by the pickup roller 101, they are separated one by one by the feed roller 102 and the retard roller 103, and one sheet is delivered at a time from the manual sheet feeding apparatus 100. After that, the sheet P is pulled by a drawing roller 104 out of a nip portion between the feed roller 102 and the retard roller 103 and is conveyed to a registration roller pair 240.

Figure 4A:
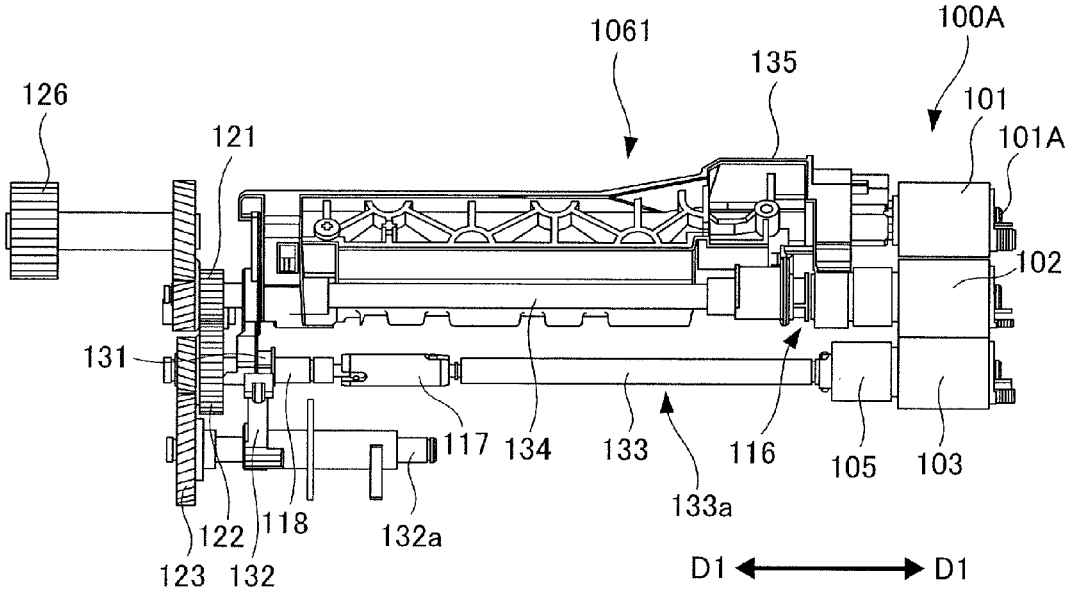
FIG. 4A is a front view illustrating a sheet feeding unit provided in the manual sheet feeding apparatus.
Figure 4B:
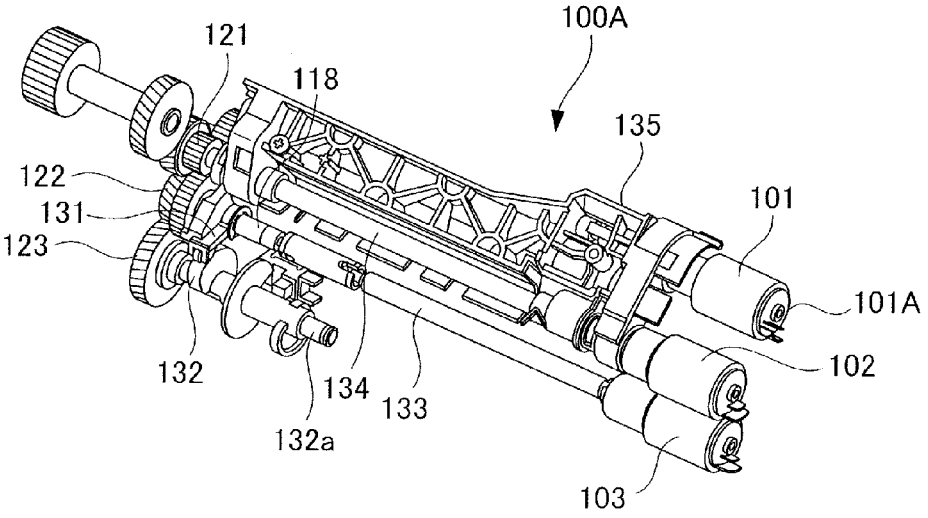
FIG. 4B is a perspective view illustrating the sheet feeding unit.

FIGS. 4A and 4B are front and perspective views respectively illustrating a sheet feeding unit 100A delivering the sheet of the manual sheet feeding apparatus 100. As shown in FIGS. 4A and 4B, the feed roller 102, i.e., a rotary conveyance member, is attached to a feed roller shaft 134, i.e., a first shaft serving as a rotary feed member shaft. The feed roller shaft 134 is rotatably supported by a bearing not shown provided in a manual feed frame F shown in FIG. 2. Attached at a back side of the printer body of the feed roller shaft 134 is a conveyance drive gear 121 which will be described in detail later.

The pickup roller 101 is rotatably supported by a sheet feed holder 135 through a pickup roller shaft 101A. The sheet feed holder 135 is a holding portion supporting the rotary feed member and is supported by the feed roller shaft 134 so as to pivot up and down. The pickup roller 101 is rotatable in synchronism with the feed roller 102 because driving force of the feed roller shaft 134 is transmitted to the pickup roller 101 through a driving gear train 116. The pickup roller 101, the pickup roller shaft 101A, the driving gear train 116, the sheet feed holder 135, and others compose a lift unit 1061.

Figure 5:
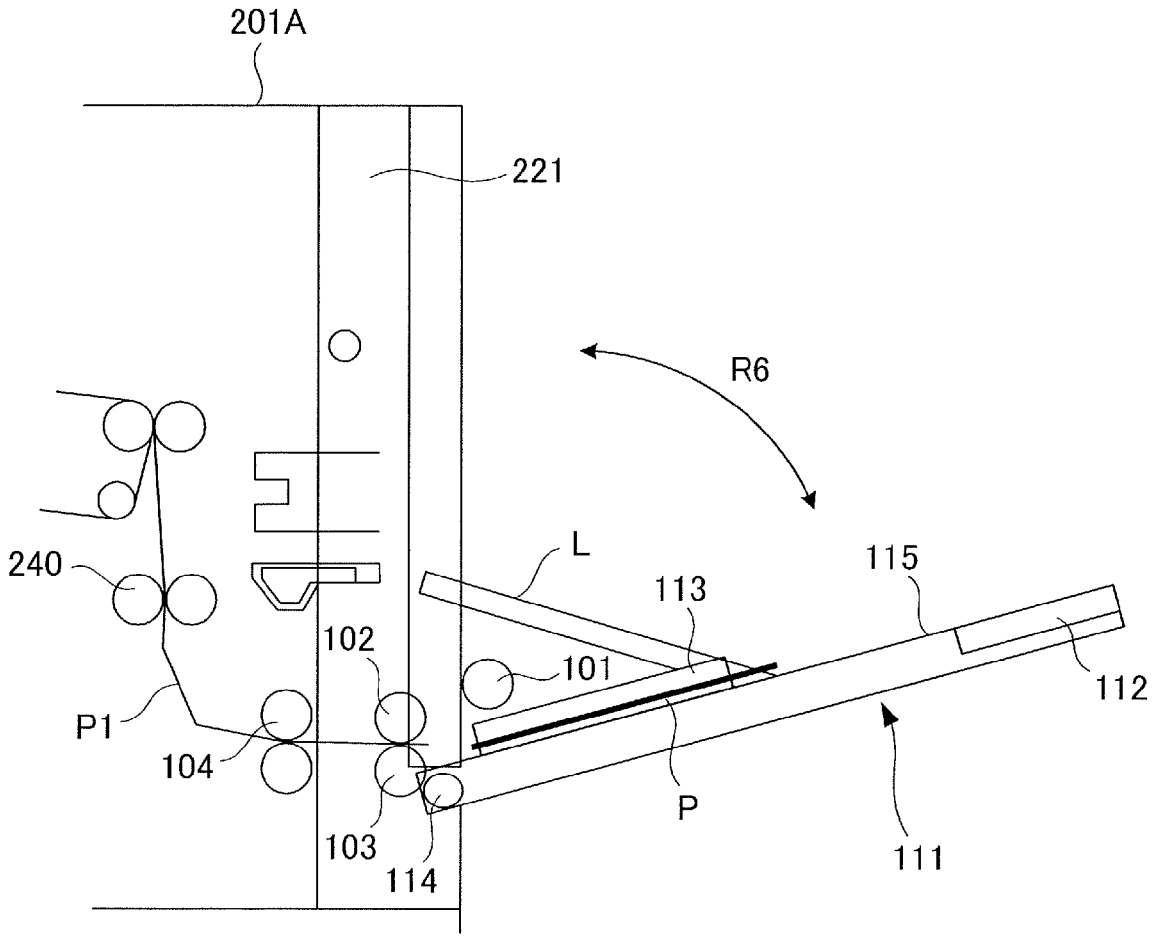
FIG. 5 is a schematic diagram illustrating a configuration of a manual sheet feed tray of the manual sheet feeding apparatus.

The retard roller 103, i.e., the rotary separation member, is attached to a supporting shaft 133. The supporting shaft 133 is supported by a holding portion not shown so as to be able to move in parallel with the vertical direction in FIG. 4A such that the retard roller 103 comes into pressure contact with and separates from the feed roller 102. The supporting shaft 133 is connected with a driving shaft 118 through a coupling 117. A separation drive stepped gear 122 is attached at an end portion on a back side (on the left side in FIG. 4A) of the printer body of the driving shaft 118. The driving shaft 118 is supported rotatably by a bearing not shown and disposed in the manual feed frame F. Meanwhile, the supporting shaft 133 is urged toward the feed roller (upward) by a pressing spring not shown such that the retard roller 103 comes into pressure contact with the feed roller 102. The pickup roller 101, the retard roller 103, and the feed roller 102 are driven by a drive unit as described in detail later. The supporting shaft 133 and the driving shaft 118 compose a separation roller shaft 133*a*, i.e., a second shaft serving as a rotary separation member shaft configured to rotate a rotary separation member As shown in FIG. 5, the manual sheet feed tray 111, i.e., a sheet supporting portion, is pivotally supported so as to turn centering on a turning fulcrum 114 on a door 221, which is opened and closed with respect to one side surface of the printer body 201A. That is, the manual sheet feed tray 111 is opened and closed in a direction indicated by an arrow R6 by a lower-hinge configuration with respect to the door 221. In opening/closing the manual sheet feed tray 111, a user holds a grip 115 provided at an end of the manual sheet feed tray 111. When the manual sheet feed tray 111 is opened, the manual sheet feed tray 111 is held by a holding link L with a predetermined angle with respect to the side surface of the printer body 201A. The pickup roller 101 moves up and down appropriately with respect to the manual sheet feed tray 111 whose position is fixed by being held by the holding link L so as to deliver a sheet stacked on the tray.

Figure 6A:
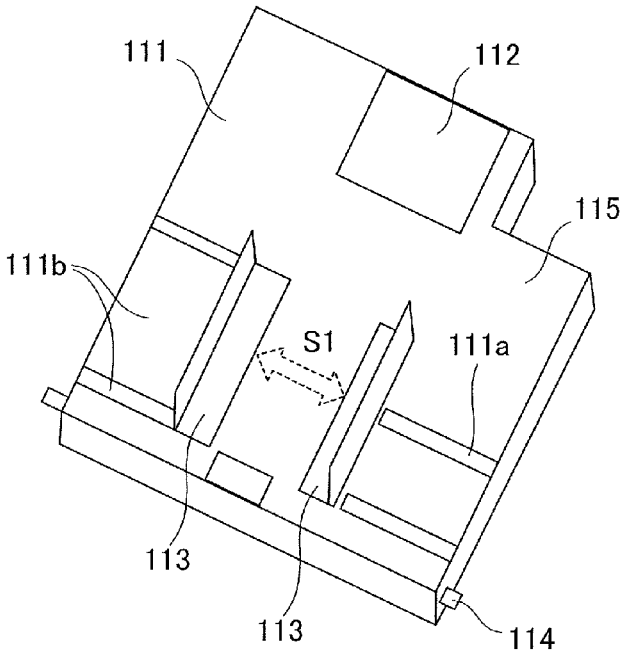
FIG. 6A is a perspective view illustrating the manual sheet feed tray in a state in which an auxiliary tray is stored.

As shown in FIG. 5, the manual sheet feed tray 111 is provided with a side regulating plate 113 regulating a position of the sheet P in a width direction orthogonal to a sheet feeding direction. As shown in FIG. 6A, the side regulating plate 113 is movable in a width direction indicated by an arrow S1, being guided by guide grooves 111*a* and 111*b* provided along the width direction on an upper surface of the manual sheet feed tray 111. Thus, it is possible to regulate the sheet widthwise position by moving the side regulating plate 113 to a position corresponding a width of the sheet P after setting the sheet on the manual sheet feed tray 111.

Figure 6B:
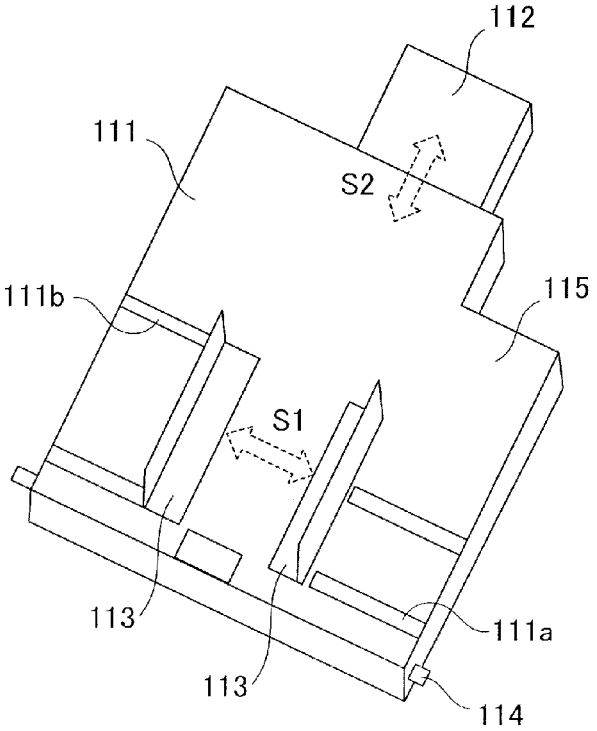
FIG. 6B is a perspective view illustrating the manual sheet feed tray in a state in which the auxiliary tray is drawn out.

Still further, as shown in FIGS. 6A and 6B, an auxiliary tray 112 is stored at an end of the manual sheet feed tray 111 such that the auxiliary tray 112 can be drawn out along the sheet feeding direction indicated by an arrow S2. The auxiliary tray 112 is used by sliding the auxiliary tray 112 out of the manual sheet feed tray 111 as shown in FIG. 6B from a storage position shown in FIG. 6A in feeding a sheet such as A3 size or B4 size sheet that sticks out of the manual sheet feed tray 111.

Figure 7:
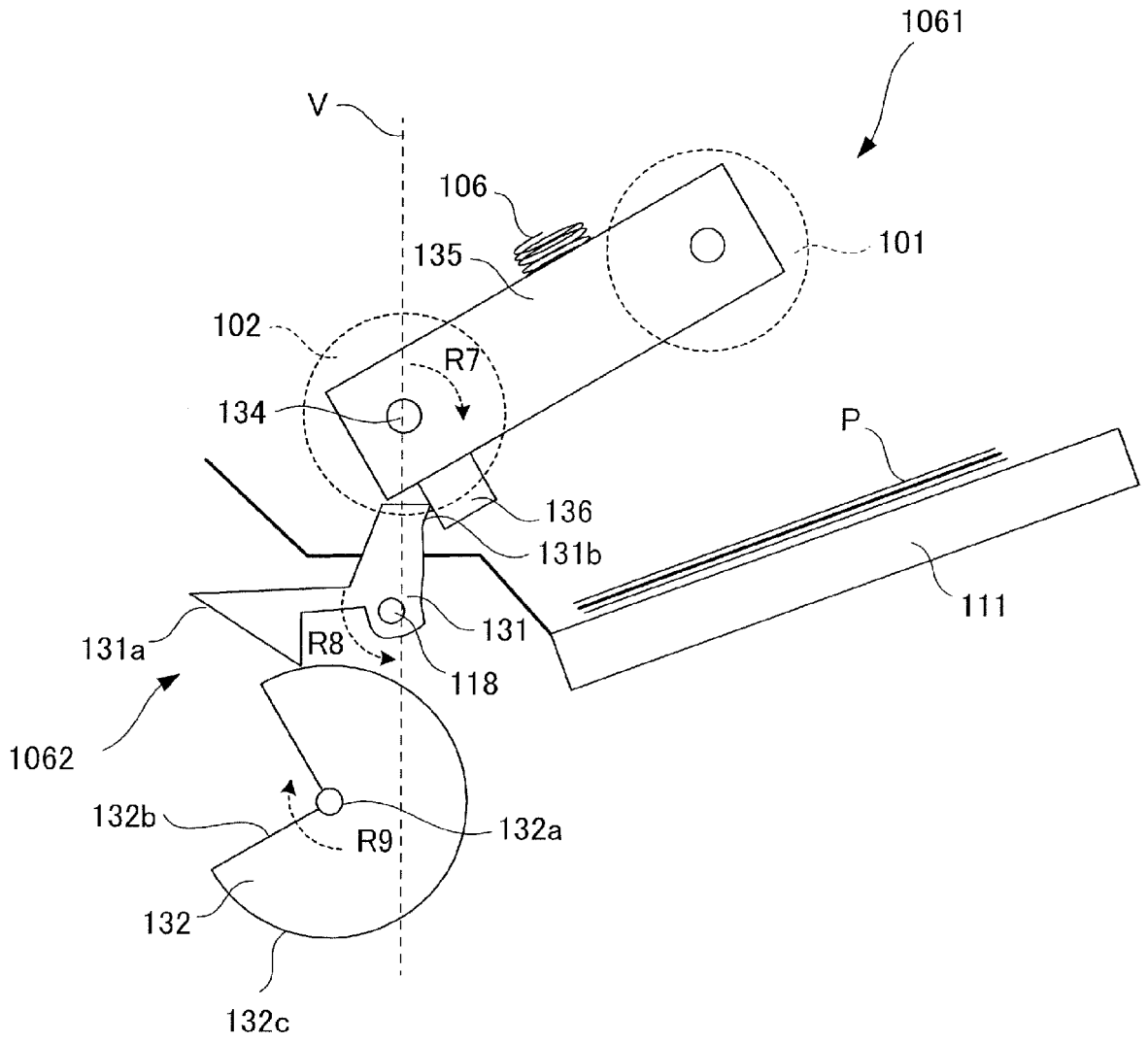
FIG. 7 is a schematic diagram illustrating a configuration of a lifting portion for lifting a lift unit of the sheet feeding unit.

As shown in FIG. 7, a pressing spring 106, i.e., an urging member is attached between the manual feed frame F and the sheet feed holder 135. The lift unit 1061 is biased so as to turn in a direction indicated by an arrow R7 at a fulcrum of the feed roller shaft 134 by the urging force (resilient force) of the pressing spring 106. Here, a convex portion 136, i.e., an abutment portion, is provided on a side facing the feed roller shaft 134 of the sheet feed holder 135, that is, on a bottom surface of the sheet feed holder 135.

Figure 8:
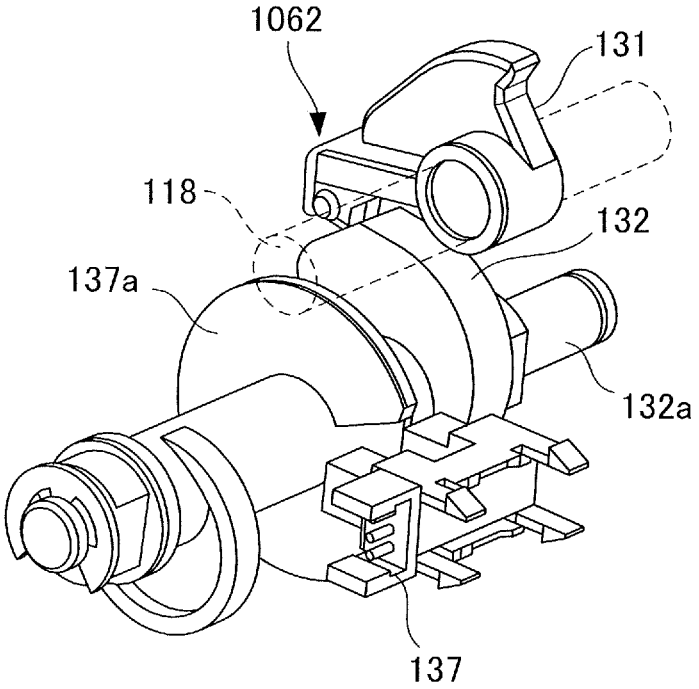
FIG. 8 is a perspective view illustrating a cam follower and a cam of the lifting portion.

A cam follower 131, i.e., an actuation member, is turnably attached to the driving shaft 118 composing the separation roller shaft 133*a*. The cam follower 131 is disposed such that an upper end thereof comes into contact with the convex portion 136 of the sheet feed holder 135. The cam follower 131 is supported on the driving shaft 118 and is turnable independently from the driving shaft 118 around an axial line of the driving shaft 118 while being restricted movement in an axial direction. Provided under the cam follower 131 is a cam 132, i.e., a drive member. As shown in FIG. 8, the cam 132 is attached to a cam shaft 132*a*, which is rotatably supported by the sheet feed frame not shown, and rotates as a whole with the cam shaft 132*a*. The cam 132 serving as a drive member and the cam follower 131 serving as an actuation member compose a lifting portion 1062 lifting the lift unit 1061.

As shown in FIG. 7, the feed roller shaft 134, the driving shaft 118, and the cam shaft 132*a* are disposed in this order from up to down and in parallel. The cam shaft 132*a* is provided with the cam 132. The cam follower 131 in sliding contact with the cam 132 is turnable with respect to the driving shaft 118. Still further, the respective shafts 134, 118 and 132*a* are disposed approximately along a vertical line V passing through the feed roller shaft 134 without largely displaced from the vertical line V.

It is possible to efficiently dispose the manual sheet feeding apparatus 100 in a narrow area of one side surface of the printer body 201A by disposing the respective shafts 134, 118 and 132 in the vertical direction as described above. That is, it is possible to minimize a range in a lateral direction occupied by the manual sheet feeding apparatus 100 in a front view of the printer body 201A by disposing the cam 132, the cam follower 131, and the respective shafts 134, 118, and 132*a* like the present embodiment. This arrangement makes it possible to suppress the size of the printer body 201A from being increased and to construct the printer body 201A in compact in the width direction.

In response to a rotation of the cam shaft 132*a* by being driven by a drive unit described later, the cam 132 rotates to turn the cam follower 131. As shown in FIG. 8, the cam shaft 132*a* is provided with a detection flag 137*a*, i.e., a detection target portion to be detected, for detecting that the rotary feed member is located at a home position (standby position). A photosensor 137, i.e., a detector to detect the detection target portion, detects the detection flag 137*a* and sends a signal corresponding to a presence of the detection flag 137*a*. The control portion 260 detects that the pickup roller 101 is located at the standby position by detecting the detection flag 137*a* through the photosensor 137.

FIG. 7 illustrates the manual sheet feeding apparatus 100 before feeding a sheet. At this time, the pickup roller 101 is located at the standby position separated above from the sheet P on the manual sheet feed tray 111. At this time, the convex portion 136 of the sheet feed holder 135 engages (abuts) with the upper end 131*b*, which serves as an engage portion, of the cam follower 131 while being pressed in a direction of an arrow R7 by the urging force (resilient force) of the pressing spring 106. While a load turning the cam follower 131 in a direction indicated by an arrow R8 is applied to the cam follower 131 due to the engagement with the convex portion 136, the cam follower 131 is restricted from turning by the cam 132. Therefore, the cam follower 131 does not turn and keeps its position, and the pickup roller 101 is held at the standby position.

Figure 9:
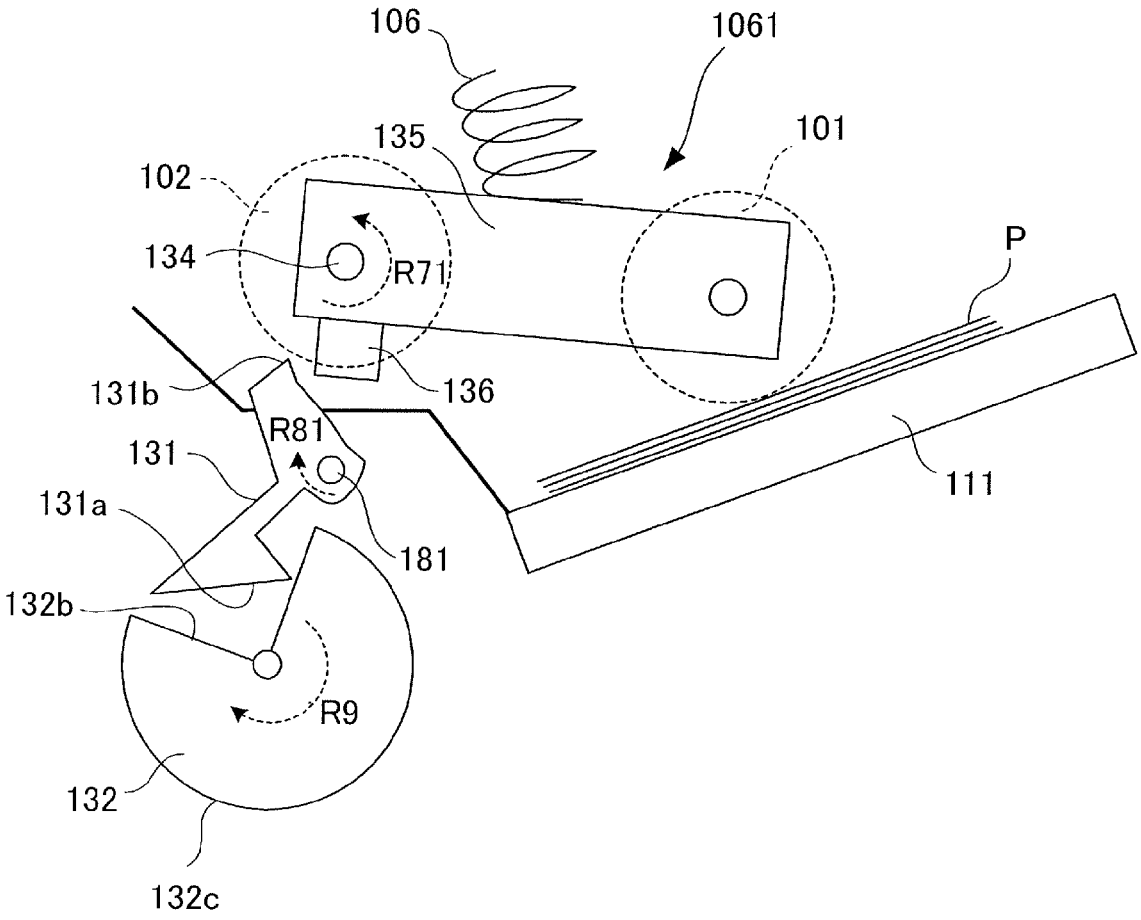
FIG. 9 is a schematic diagram illustrating the lift unit and the lifting portion in a state in which the lift unit is lowered.

In response to a start of a sheet feeding operation, the drive unit described later is driven, and the cam 132 rotates in a direction indicated by an arrow R9 in FIG. 7. Following to the rotation of the cam 132, a contact portion 131*a* of the cam follower 131, which is in contact with a circumferential surface 132*c* of the cam 132, rotates in the direction of the arrow R8. That is to say, the cam follower 131 comes to be apart from a circumferential surface 132*c* of the cam 132 and enters into a cutaway part 132*b* of the cam 132 as shown in FIG. 9, and the lift unit 1061 turns downward by the resilience force of the pressing spring 106. Thereby, the pickup roller 101 drops and abuts with the sheet P on the manual sheet feed tray 111. Thus, the abutment position of the pickup roller 101 where the pickup roller 101 abuts with an upper surface of the sheet P varies in the vertical direction corresponding to an amount of the sheets stacked on the manual sheet feed tray 111.

After that, in response to the rotation of the cam 132 in the direction of the arrow R9 in FIG. 9, by the inclined surface of the contact portion 131*a* being pressed by the cam 132, the cam follower 131 turns in a direction indicated by an arrow R81 and presses the convex portion 136 of the sheet feed holder 135. Thereby, the lift unit 1061 turns in a direction indicated by an arrow R71 centering on the feed roller shaft 134 and moves to the standby position shown in FIG. 7. When the pickup roller 101 reaches the standby position, the photosensor 137 detects the cam 132 and thereby, the control portion 260 stops turning of the cam 132.

Figure 10:
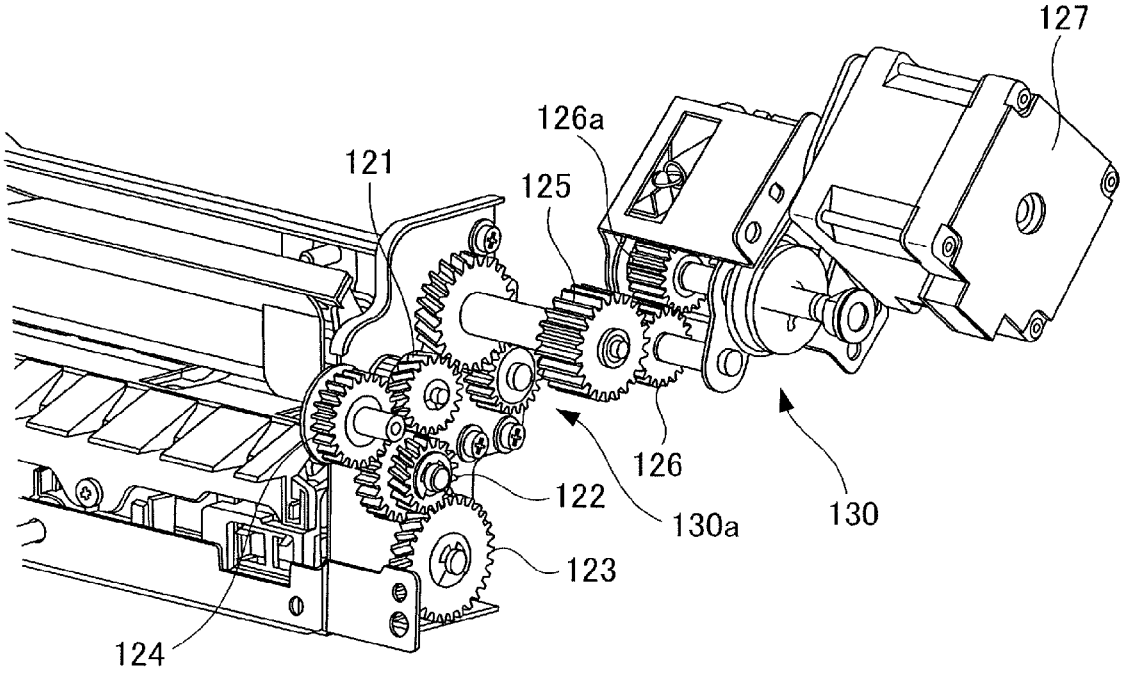
FIG. 10 is a perspective view illustrating a drive unit driving the sheet feeding unit.
Figure 11:
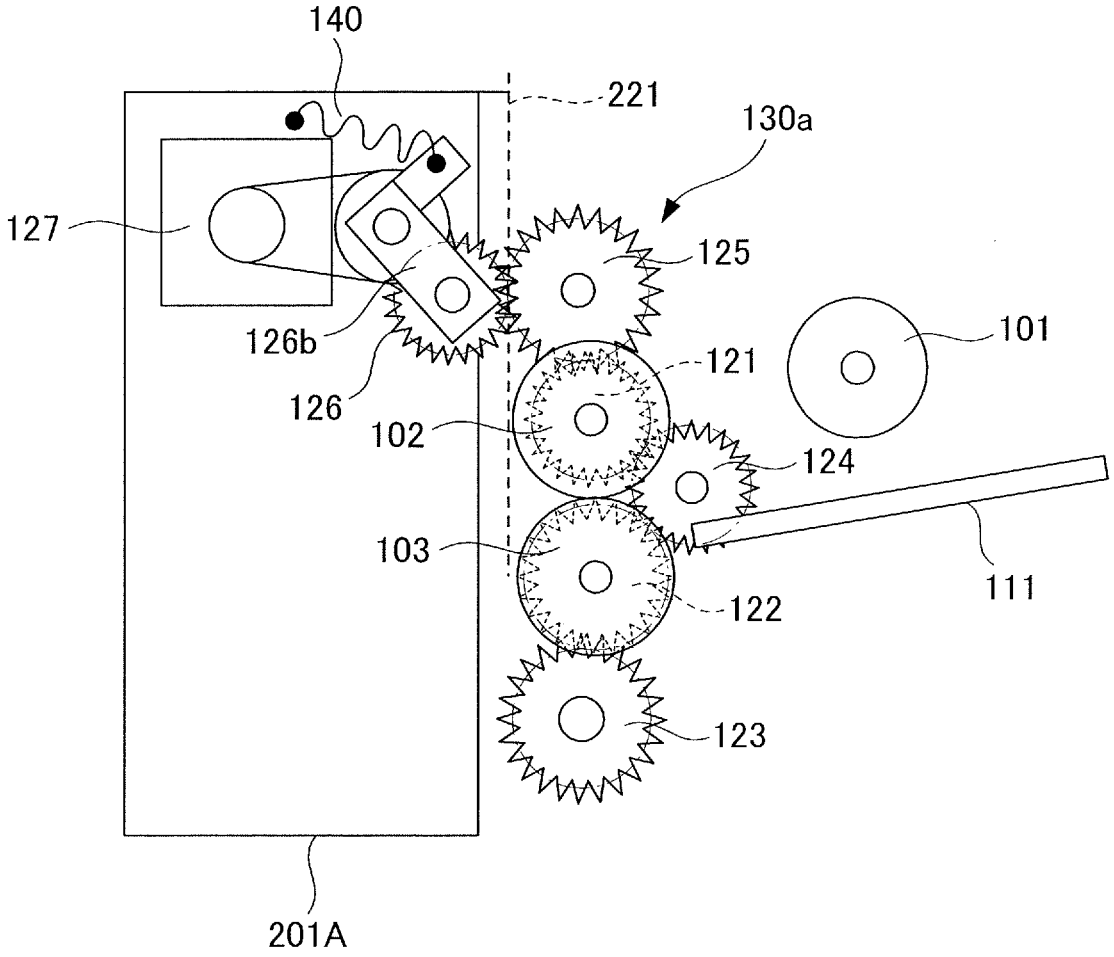
FIG. 11 is schematic diagram a illustrating a drive transmitting portion of the drive unit.

FIG. 10 illustrates a configuration of the drive unit 130 driving the sheet feeding unit and rotating the cam 132. The drive unit 130 includes a sheet feed motor 127 capable of rotating in a normal direction and in a reverse direction, a driving gear 126*a* rotated by the sheet feed motor 127, a rocking gear 126 meshing with the driving gear 126*a*, and a stepped gear 125 meshing with the rocking gear 126. As shown in FIG. 11, the driving gear 126*a*, the rocking gear 126, and the sheet feed motor 127, i.e., a drive unit serving as a driving source, are provided in the printer body 201A and the stepped gear 125 and others are provided in the door 221 (unit side) in the present embodiment.

It is noted that the sheet feed motor 127 may be installed in the door 221. However, if the sheet feed motor 127 is installed in the door 221, serviceability is worsened because a bundle of wires becomes complicated by providing the electric component on the door 221 side and it becomes cumbersome in replacing the manual sheet feeding unit due a failure of a component and others for example. Still further, as the weight of the door 221 increases, operability in opening/closing the door 221 is worsened. Therefore, the sheet feed motor 127 is installed in the printer body 201A to lighten and to improve serviceability of the door 221 in the present embodiment.

Still further, the rocking gear 126 rotated by the sheet feed motor 127 is made to rock such that the rocking gear 126 can be securely meshed with the stepped gear 125 provided in the door 221. That is, according to the present embodiment, the rocking gear 126 is meshed firmly with the stepped gear 125 by configuring the gear driven by the sheet feed motor 127 as the rocking gear. It is noted that the rocking gear 126 is rotatably held by a holder 126*b*. The holder 126*b* is urged in a direction of meshing the rocking gear 126 with the stepped gear 125 by the pressing spring 140.

In the sheet feeding operation, the rotation of the rollers conveying the sheet is essential in conveying the sheet. For instance, if a meshing part of the rocking gear 126 and the stepped gear 125 causes tripping, feeding failure of the sheet occurs and the sheet feeding operation does not finish. Meanwhile, the rotation of the cam 132, i.e., the lifting operation of the pickup roller 101, is less influential to the sheet feeding operation even if tripping occurs.

Figure 12A:
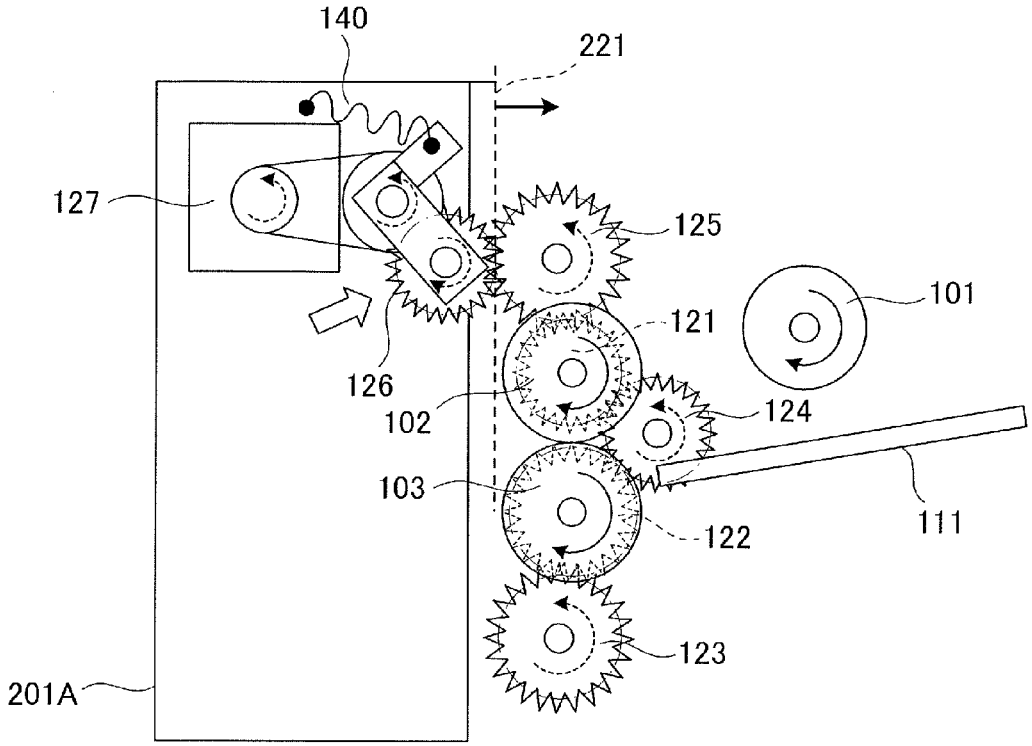
FIG. 12A is a schematic diagram illustrating an operation of the drive transmitting portion when a motor is rotated in a normal direction.

Therefore, as shown in FIG. 12A, the sheet feed motor 127 is rotated in the normal direction as indicated by an arrow in feeding a sheet such that the rocking gear 126 urged by the pressing spring 140 rotates in a direction of biting into the stepped gear 125 (indicated by a void arrow) in the present embodiment. Because this arrangement makes it possible to mesh the rocking gear 126 securely with the stepped gear 125, tripping at the gear mesh part is reduced in feeding the sheet by the pickup roller 101.

Figure 12B:
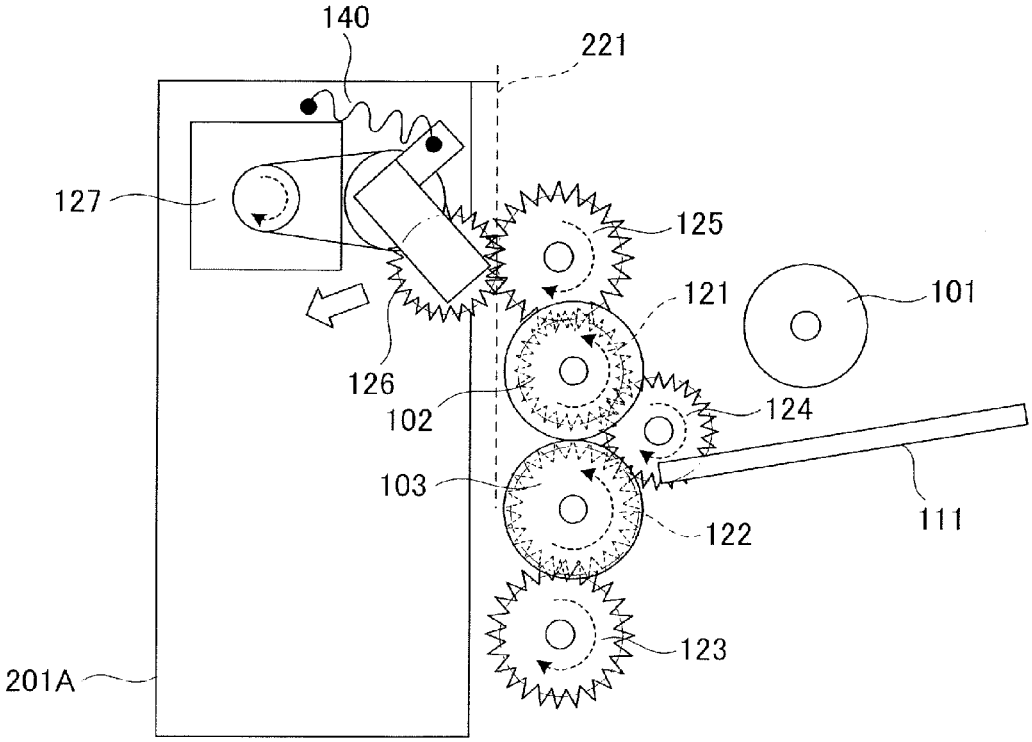
FIG. 12B is a schematic diagram illustrating an operation of the drive transmitting portion when the motor is rotated in a reverse direction.

The rotation direction of the sheet feed motor 127 in feeding the sheet as described above is the normal direction. Meanwhile, the sheet feed motor 127 is rotated in the reverse direction in lifting the pickup roller 101. Then, as shown in FIG. 12B, in a case when the sheet feed motor 127 is rotated as indicated by an arrow, the rocking gear 126 rotates in a direction of escaping from the stepped gear 125 (void arrow). By setting a rotation direction of the rocking gear 126 into the direction escaping from the stepped gear 125 as described above, it is possible to prevent the gear meshing part from tripping even if such an unassumed operation of applying a load to the sheet feed holder 135 in lifting the pickup roller 101.

Meanwhile, the stepped gear 125 provided on the unit side is meshed with the conveyance drive gear 121 as shown in FIG. 10. The conveyance drive gear 121 meshes with the idler gear 124 and the idler gear 124 meshes with the separation drive stepped gear 122. The separation drive stepped gear 122 also meshes with a cam driving gear 123. Thereby, the rotation of the sheet feed motor 127 is transmitted in order of the driving gear 126*a*, the rocking gear 126, the stepped gear 125, the conveyance drive gear 121, the idler gear 124, the separation drive stepped gear 122 and the cam driving gear 123. Then, the driving gear 126*a* and others compose a drive transmitting portion 130*a* transmitting the rotation of the sheet feed motor 127 to the pickup roller 101, the feed roller 102, and the retard roller 103 or the cam 132.

Figure 13:
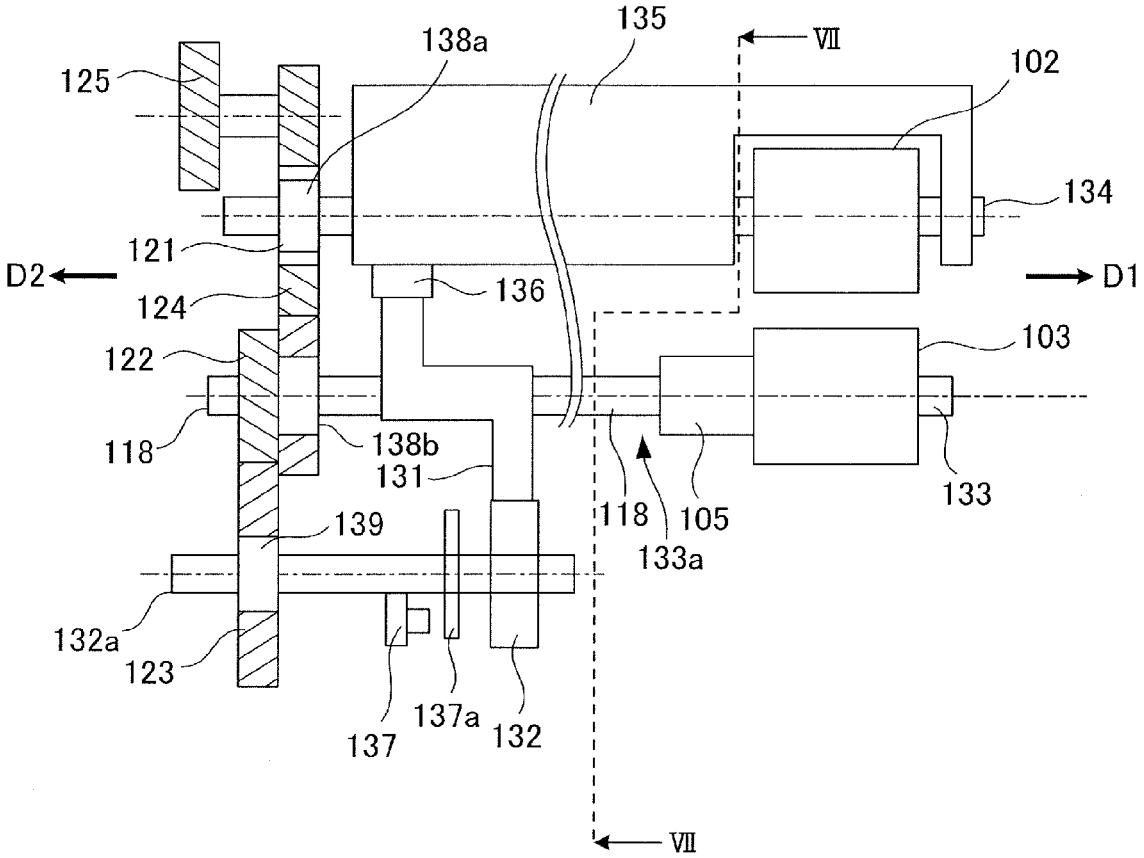
FIG. 13 is schematic diagram a illustrating a configuration of the drive transmitting portion.

Here, as shown in FIG. 13, a first one-way clutch 138*a* is provided between the feed roller shaft 134 and the conveyance drive gear 121 in the present embodiment. Still further, a second one-way clutch 138*b* is provided between the supporting shaft 133 and the separation drive stepped gear 122, and a third one-way clutch 139 is provided between the cam shaft 132*a* and the cam driving gear 123.

The first one-way clutch 138*a* is configured to transmit a rotation of the conveyance drive gear 121 (in a direction indicated by an arrow in FIG. 12A) caused by the normal rotation of the sheet feed motor 127 to the feed roller shaft 134. Meanwhile, the first one-way clutch 138*a* does not transmit a rotation of the conveyance drive gear 121 (in a direction indicated by an arrow in FIG. 12B) caused by the reverse rotation of the sheet feed motor 127 to the feed roller shaft 134.

The second one-way clutch 138*b* is configured to transmit a rotation in one direction of the separation drive stepped gear 122 (in a direction indicated by an arrow in FIG. 12A) to the supporting shaft 133. Meanwhile, the second one-way clutch 138*b* does not transmit a rotation in a reverse direction of the separation drive stepped gear 122 (in a direction indicated by an arrow in FIG. 12B) to the supporting shaft 133.

The third one-way clutch 139 is configured to transmit a rotation of the cam driving gear 123 to the cam shaft 132*a* when the conveyance drive gear 121 and the separation drive stepped gear 122 rotate in a direction indicated by arrows in FIG. 12B due to the reverse rotation of the sheet feed motor 127. Meanwhile the third one-way clutch 139 does not transmit a rotation of the cam driving gear 123 to the cam shaft 132*a* when the conveyance drive gear 121 and the separation drive stepped gear 122 rotate in a direction indicated by arrows in FIG. 12A due to the normal rotation of the sheet feed motor 127.

Thus, provided with the one-way clutches 138*a*, 138*b*, and 139 as described above, the feed roller shaft 134 and the supporting shaft 133 is rotated by the operations of the first and second one-way clutches 138*a* and 138*b* when the sheet feed motor 127 rotates in the normal direction, thereby the pickup roller 101, the feed roller 102, and the retard roller 103 being rotated. At this time, because the cam driving gear 123 idles by the third one-way clutch 139, the cam 132 does not rotate.

Still further, in response to the reverse rotation of the sheet feed motor 127, the conveyance drive gear 121 and the separation drive stepped gear 122 idle due to the first and second one-way clutches 138*a* and 138*b*, and the pickup roller 101, the feed roller 102, and the retard roller 103 do not rotate. Meanwhile, the cam driving gear 123 rotates due to the third one-way clutch 139, so that the cam 132 rotates and along with that, the sheet feed holder 135 is lifted through the cam follower 131. Thus, according to the present embodiment, it is possible to conduct the sheet feeding operation and the lifting operation of the pickup roller 101 by the normal and reverse rotations of the sheet feed motor 127.

Figure 14:
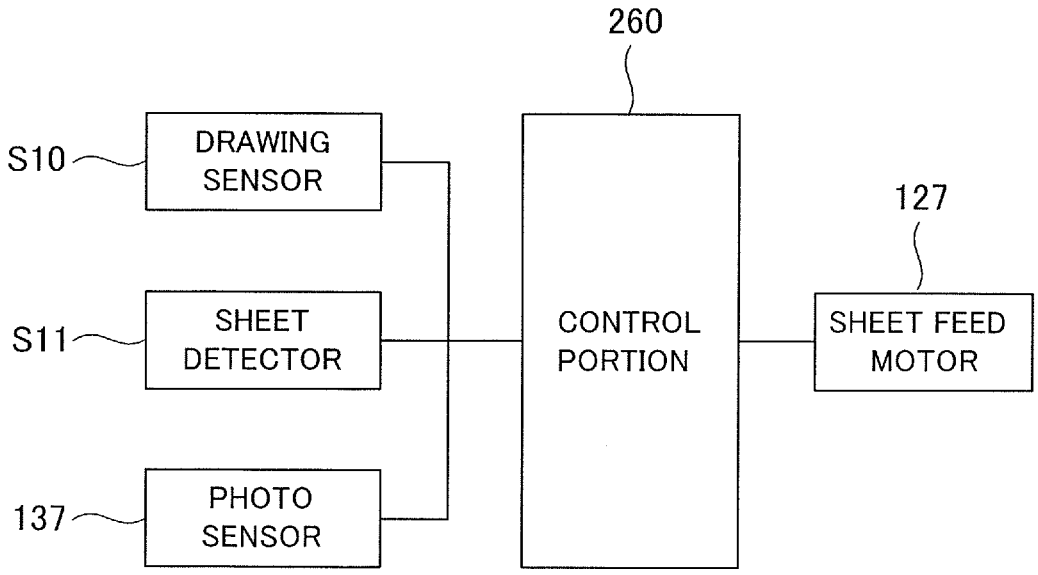
FIG. 14 is a block diagram illustrating a configuration to control the manual sheet feeding apparatus.

FIG. 14 is a block diagram for control of the manual sheet feeding apparatus 100 of the present embodiment. A drawing sensor S10 is provided downstream the drawing roller 104, and the control portion 260 detects through the drawing sensor S10 that a sheet is pulled out by the drawing roller 104. A sheet detector S11 detects whether or not a sheet is present on the manual sheet feed tray 111. As shown in FIG.

14, the control portion 260 is connected with the drawing sensor S10, the sheet detector S11, and the abovementioned sheet feeding motor 127 and the photosensor 137.

Next, a control operation made by the control portion 260 will be described. Until when the sheet feeding operation is started, the pickup roller 101 is made to stand by at the standby position separated from the sheet P on the manual sheet feed tray 111 as shown in FIG. 11. Then, in feeding the sheet, the control portion 260 detects whether or not a sheet is present on the manual sheet feed tray 111 through the sheet detector S11. When the control portion 260 determines that the sheet is present on the manual sheet feed tray 111, the control portion 260 rotates the sheet feed motor 127 in the reverse direction.

Thereby, the cam 132 rotates and the cam follower 131 turns in the direction indicated by the arrow R8 from the state shown in FIG. 7 to the state shown in FIG. 9. Thus, the sheet feed holder 135 turns downward. Then, due to the downward turn of the sheet feed holder 135, the pickup roller 101 drops and comes into contact with the sheet P on the manual sheet feed tray 111. The control portion 260 stops the sheet feed motor 127 after bringing the pickup roller 101 into contact with the sheet.

Next, the control portion 260 rotates the sheet feed motor 127 in a normal direction. Thereby, the pickup roller 101, the feed roller 102, and the retard roller 103 rotate and feed the sheet one by one. Here, a time during which the sheet feed motor 127 is rotated in a normal direction is set based on the size of the sheet to be fed, which size is detected by the drawing sensor S10. Then, the set time elapses and the feed of the sheet ends, the control portion 260 rotates the sheet feed motor 127 in the reverse direction to move the pickup roller 101 to the standby position.

In the case of a consecutive sheet feeding, the control portion 260 repeats ON (normal rotation) and OFF of the sheet feed motor 127 to repeat the rotation and stop of the pickup roller 101, the feed roller 102, and the retard roller 103. A distance (inter-sheets) between a preceding sheet and a succeeding sheet to be consecutively fed is set by an OFF time of the sheet feed motor 127.

Here, it takes a long time and the inter-sheet distance is prolonged if the pickup roller 101 is lifted every time when one sheet is delivered. Then, according to the present embodiment, the lifting operation of the pickup roller 101 is not carried out and the pickup roller 101 is kept in contact with the sheet in consecutively feeding the sheets. Then, the pickup roller 101 is lifted to the standby position as soon as the job ends.

It is possible to minimize the inter-sheet distance and to increase productivity as the image forming apparatus just by repeating the rotation and stoppage of the sheet feed motor 127 without lifting the pickup roller 101 as described above. It is noted that if the sheet feed motor 127 is switched to OFF, both the pickup roller 101 and the feed roller 102 stop, thus losing power for delivering the sheet. Therefore, timing for turning OFF the sheet feed motor 127 must be set after when a front edge of the delivered sheet arrives at the drawing roller 104.

Here, the cam follower 131 is disposed turnably around the driving shaft 118 (the second shaft 133*a*) as shown in FIG. 13 in the present embodiment. It is possible to readily realize a disposition by which the cam follower 131 will not interfere with the other members including the driving shaft 118 by disposing the cam follower 131 around the driving shaft 118. As a result, it becomes unnecessary to provide another shaft for turnably supporting the cam follower 131 at a place (upstream in the sheet feeding direction in particular) distant from the driving shaft 118. This arrangement makes it possible to downsize the manual sheet feeding apparatus 100, to shorten a length of the manual sheet feeding apparatus 100 in the sheet feeding direction, and to suppress the printer body 201A from being enlarged sidewise. It is also possible to design the manual sheet feeding apparatus 100 in compact more than a case of separately providing the cam shaft 132*a* and a rotation shaft of the detection flag 137*a* by providing the detection flag 137*a* on the cam shaft 132*a*.

Note that while it is also possible to directly push up the sheet feed holder 135 by a cam without interposing the cam follower 131, the cam should be disposed so as to avoid the driving shaft 118 if a movable range in lifting the sheet feed holder 135 is taken into account. In this case, a cam shaft must be disposed in a vicinity of an upstream in the sheet feeding direction of the driving shaft 118. As a result, the length in the sheet feeding direction of the manual sheet feeding apparatus 100 is prolonged, thus increasing the sizes of the manual sheet feeding apparatus 100 and of the printer body.

As described above, the cam follower 131 is turnably disposed around the supporting shaft 133 in the present embodiment. This arrangement makes it possible to prevent the cam follower 131 from interfering with the supporting shaft 133. As a result, it is possible to lift the pickup roller at a low cost without increasing the size of the sheet feeding apparatus configured to be able to lift the pickup roller and to drive the pickup roller and others by one motor.

It is noted that while the case of feeding the sheet and of lifting the pickup roller by bidirectional rotation of the motor has been shown in the present embodiment, it is also possible to arrange such that the feed of the sheet and the lift of the pickup roller are made by rotating the motor in one direction (only the normal rotation). In this case, because rotations of the pickup roller, the feed roller, and the retard roller and the rotation of the cam must be made at different timings, it is necessary to provide a mechanism such as a clutch for transmitting and disconnecting the drive in the respective driving systems. It is also possible to arrange such that the feed roller, the retard roller and the cam are rotationally driven by different driving sources.

Still further, while the sheet feeding apparatus is configured such that the rotation from the sheet feed motor 127 is transmitted to the retard roller 103 in the direction opposite to the sheet feeding direction, the sheet feeding apparatus may be configured such that no rotation is transmitted to the retard roller 103. That is, while the separation roller shaft 133*a* composed of the supporting shaft 133 and the driving shaft 118 and the torque limiter 105 are configured in the same manner with the present embodiment, the driving shaft 118 is fixed to the sheet feed frame so as not to rotate. Thereby, when a plurality of sheets enters the nip portion between the feed roller 102 and the retard roller 103, the sheets are delivered by being separated one by one by stopping the retard roller 103 to restrict the sheet under the uppermost sheet from moving.

Still further, while the case when the present invention is applied to the manual sheet feeding apparatus, i.e., one example of the sheet feeding apparatus, has been described in the present embodiment, the present invention is applicable to a sheet feeding apparatus feeding a sheet stacked in a cassette. Still further, while the case in which the present invention is applied to the electrophotographic type image forming apparatus has been described in the present embodiment described above, the present invention is also applicable to an inkjet type image forming apparatus. Still further, while the rotary feed member, the rotary conveyance member, the rotary separation member have been exemplified by using the rollers in the present embodiment described above, a belt-like rotary member may be also used other than the rollers.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-095891, filed on May 8, 2015, which is hereby incorporated by reference herein in its entirety.

What is claimed is:

1. A sheet feeding apparatus comprising:

a sheet supporting portion configured to support a sheet;

a rotary feed member configured to rotate in a first direction so as to feed the sheet supported on the sheet supporting portion;

a rotary conveyance member configured to rotate in the first direction so as to convey the sheet fed from the rotary feed member;

a rotary separation member being in pressure contact with the rotary conveyance member and configured to be driven in a second direction opposite to the first direction so as to separate the sheet being fed by the rotary conveyance member from another sheet supported on the sheet supporting portion;

a first shaft configured to rotate the rotary conveyance member;

a second shaft configured to rotate the rotary separation member;

a holding portion rotatably provided on the first shaft and configured to hold the rotary feed member rotatably;

a lifting portion configured to move the holding portion so as to move the rotary feed member to a standby position located above the sheet supported on the sheet supporting portion and an abutment position on which the rotary feed member abuts with the sheet supported on the sheet supporting portion; and a drive unit configured to drive the lifting portion, wherein the lifting portion comprises a first member rotatably provided on the second shaft, the first member being configured to rotate by driving force of the drive unit and lift the holding portion such that the rotary feed member moves from the abutment position to the standby position.

2. The sheet feeding apparatus according to claim 1, wherein the lifting portion further comprises a second member comprising a cam rotated by the drive unit, and the first member comprises a cam follower rotated by the cam, and wherein the cam follower is supported by the second shaft so as to turn around independently from the second shaft.

3. The sheet feeding apparatus according to claim 2, further comprising an urging member urging the holding portion such that the rotary feed member abuts with an upper surface of the sheet supported on the sheet supporting portion, wherein the cam follower moves the holding portion while resisting against an urging force of the urging member by being rotated by the cam, so as to separate the rotary feed member from the upper surface of the sheet.

4. The sheet feeding apparatus according to claim 2, wherein the cam is fixed to a cam shaft to which driving force from the drive unit is transmitted, and wherein the first shaft, the second shaft, and the cam shaft are disposed downward in this order along a vertical line passing through the first shaft.

5. The sheet feeding apparatus according to claim 2, further comprising a cam shaft on which the cam is fixed, the cam shaft being rotated by the driving force from the drive unit, a detection target portion provided on the cam shaft, a detector configured to detect the detection target portion and transmit a signal upon detecting the detection target portion, and a control portion controlling the drive unit based on the signal from the detector.

6. The sheet feeding apparatus according to claim 1 further comprising a drive transmitting portion transmitting driving force of the drive unit, wherein the drive unit is a motor which rotates in normal and reverse directions, and wherein the drive transmitting portion transmits the driving force of the motor to the rotary feed member when the motor rotates in the normal direction and transmits the driving force of the motor to the first member when the motor rotates in the reverse direction.

7. A sheet feeding apparatus comprising:

a sheet supporting portion configured to support the sheet;

a rotary feed member configured to be in contact with an upper surface of the sheet supported on the sheet supporting portion so as to feed the sheet;

a rotary conveyance member configured to convey the sheet fed from the rotary feed member;

a rotary separation member being in pressure contact with the rotary conveyance member from underneath of the rotary conveyance member;

a first shaft configured to rotate the rotary conveyance member;

a holding portion configured to hold the rotary feed member rotatably and configured to pivot up and down centering on the first shaft;

a second shaft disposed under the first shaft and configured to rotate the rotary separation member;

a cam shaft with a cam, the cam shaft being disposed under the first shaft and being driven by a driving source;

a cam follower supported on the second shaft so as to turn around independently from the second shaft along with a rotation of the cam; and an abutment portion provided on the holding portion and configured to abut with the cam follower, wherein the rotary feed member is movable between an abutment position where the rotary feed member abuts with the sheet supported on the sheet supporting portion and a standby position separated from the sheet, and wherein the cam follower abuts with the abutment portion to turn the holding portion along with the rotation of the cam so as to move the rotary feed member to the abutment position and standby position.

8. The sheet feeding apparatus according to claim 7, further comprising an urging member urging the holding portion such that the rotary feed member abuts with an upper surface of the sheet supported on the sheet supporting portion, wherein the cam follower turns the holding portion while resisting against an urging force of the urging member by being turned by the cam, so as to separate the rotary feed member from the upper surface of the sheet.

9. The sheet feeding apparatus according to claim 7, further comprising a drive transmitting portion configured to transmit driving force of the driving source, wherein the driving source is a motor which rotates in normal and reverse directions, and wherein the drive transmitting portion transmits the driving force of the motor to the rotary feed member when the motor rotates in the normal direction and transmits the driving force of the motor to the cam when the motor rotates in the reverse direction.

10. An image forming apparatus for forming an image on a sheet, the image forming apparatus comprising:

an image forming unit configured to form the image on the sheet; and a sheet feeding apparatus configured to feed the sheet to the image forming unit, the sheet feeding apparatus comprising:

a sheet supporting portion configured to support a sheet;

a rotary feed member configured to rotate in a first direction so as to feed the sheet supported on the sheet supporting portion;

a rotary conveyance member configured to rotate in the first direction so as to convey the sheet fed from the rotary feed member;

a rotary separation member being in pressure contact with the rotary conveyance member and configured to be driven in a second direction opposite to the first direction so as to separate the sheet being fed by the rotary conveyance member from another sheet supported on the sheet supporting portion;

a first shaft configured to rotate the rotary conveyance member;

a second shaft configured to rotate the rotary separation member;

a holding portion rotatably provided on the first shaft and configured to hold the rotary feed member rotatably;

a lifting portion configured to move the holding portion so as to move the rotary feed member to a standby position located above the sheet supported on the sheet supporting portion and an abutment position on which the rotary feed member abuts with the sheet supported on the sheet supporting portion; and a drive unit configured to drive the lifting portion, wherein the lifting portion comprises a first member rotatably provided on the second shaft, the first member being configured to rotate by driving force of the drive unit and lift the holding portion such that the rotary feed member moves from the abutment position to the standby position.

11. The image forming apparatus according to claim 10, wherein the sheet supporting portion comprises a manual sheet feed tray provided on a side portion of the image forming apparatus, and wherein the rotary feed member feeds the sheet supported on the manual sheet feed tray.

12. An image forming apparatus for forming an image on a sheet, the image forming apparatus comprising:

an image forming unit configured to form the image on the sheet; and a sheet feeding apparatus configured to feed the sheet to the image forming unit, the sheet feeding apparatus comprising:

a sheet supporting portion configured to support the sheet;

a rotary feed member configured to be in contact with an upper surface of the sheet supported on the sheet supporting portion so as to feed the sheet;

a rotary conveyance member configured to convey the sheet fed from the rotary feed member;

a rotary separation member being in pressure contact with the rotary conveyance member from underneath of the rotary conveyance member;

a first shaft configured to rotate the rotary conveyance member;

a holding portion configured to hold the rotary feed member rotatably and configured to pivot up and down centering on the first shaft;

a second shaft disposed under the first shaft and configured to rotate the rotary separation member;

a cam shaft with a cam, the cam shaft being disposed under the first shaft and being driven by a driving source;

a cam follower supported on the second shaft so as to turn around independently from the second shaft along with a rotation of the cam; and an abutment portion provided on the holding portion and configured to abut with the cam follower, wherein the rotary feed member is movable between an abutment position where the rotary feed member abuts with the sheet supported on the sheet supporting portion and a standby position separated from the sheet, and wherein the cam follower abuts with the abutment portion to turn the holding portion along with the rotation of the cam so as to move the rotary feed member to the abutment position and standby position.

13. The image forming apparatus according to claim 12, wherein the sheet supporting portion is a manual sheet feed tray provided on a side portion of the image forming apparatus, and wherein the rotary feed member feeds the sheet supported on the manual sheet feed tray.

* * * * *